US009404707B2

(12) United States Patent
Gore

(10) Patent No.: US 9,404,707 B2
(45) **Date of Patent: *Aug. 2, 2016**

(54) AIR GUN WITH GAS SPRING ASSEMBLY

(71) Applicant: Thomas Gore, Pinckney, MI (US)

(72) Inventor: Thomas Gore, Pinckney, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/820,727

(22) Filed: Aug. 7, 2015

(65) Prior Publication Data

US 2015/0354918 A1 Dec. 10, 2015

Related U.S. Application Data

(63) Continuation-in-part of application No. 14/299,321, filed on Jun. 9, 2014, now Pat. No. 9,157,695.

(51) Int. Cl.
*F41B 11/73* (2013.01)
*F41B 11/642* (2013.01)
*F41B 11/647* (2013.01)

(52) U.S. Cl.
CPC ..... *F41B 11/642* (2013.01); *F41B 11/647* (2013.01)

(58) Field of Classification Search
CPC ..... F41B 11/642; F41B 11/73
USPC ..... 124/63–68
See application file for complete search history.

(56) References Cited

U.S. PATENT DOCUMENTS 3,500,718 A * 3/1970 Stoner ..... F41A 3/04 89/1.4
3,552,372 A * 1/1971 Wilkerson ..... F41B 11/642 124/66
3,951,038 A * 4/1976 Van Langenhoven .... B25C 1/12 102/702
3,951,126 A 4/1976 Rau
4,165,730 A 8/1979 Jaedicke et al.
4,205,651 A * 6/1980 Lante-Montefeltro Della Rovere ..... F41J 9/30 116/137 R
4,282,852 A * 8/1981 Omana ..... F41B 11/00 124/67
4,709,686 A * 12/1987 Taylor ..... F41B 11/00 124/67
4,771,758 A * 9/1988 Taylor ..... F41B 11/73 124/68
4,850,329 A * 7/1989 Taylor ..... F41B 11/73 124/66
5,193,517 A * 3/1993 Taylor ..... F41B 11/64 124/65
5,570,676 A * 11/1996 Gore ..... F41B 11/642 124/56
6,250,294 B1 * 6/2001 Lim ..... F41B 11/642 124/56
6,901,689 B1 * 6/2005 Bergstrom ..... F41B 11/64 42/1.06

(Continued)

FOREIGN PATENT DOCUMENTS

DE 2329425 A1 1/1975
EP 0460961 A2 12/1991

(Continued)

*Primary Examiner* — Michael David
(74) *Attorney, Agent, or Firm* — Quinn Law Group, PLLC

(57) ABSTRACT

A gas spring assembly is disposed within a compression chamber of an air gun, and includes a piston defining an interior pressure chamber. The piston includes a latch bushing that is disposed adjacent a rearward end of the bushing. The latch bushing defines a central bore that extends along and is concentric with a longitudinal axis of the piston. A guide rod is slideably supported within the central bore of the latch bushing. The piston is axially moveable along the longitudinal axis relative to the guide rod, between a compressed position and an un-compressed position. The guide rod includes a first end that engages the trigger assembly in abutting engagement, and a second end that engages a head portion disposed within an inner support tube within the interior pressure chamber of the piston. The latch bushing includes a ledge for engaging a sear of the trigger assembly in latching engagement.

23 Claims, 5 Drawing Sheets

(56) References Cited

U.S. PATENT DOCUMENTS

| | | | | |
|---|---|---|---|---|
| 7,854,221 | B1 * | 12/2010 | Gore | F41B 11/642 124/63 |
| 8,387,602 | B1 * | 3/2013 | Bruington | F41B 7/04 124/20.3 |
| 2009/0007895 | A1 * | 1/2009 | Kenworthy | F41B 1/00 124/62 |
| 2009/0241931 | A1 * | 10/2009 | Masse | F41B 11/62 124/76 |
| 2010/0059033 | A1 * | 3/2010 | Gore | F41B 11/642 124/68 |
| 2010/0229844 | A1 * | 9/2010 | Gore | F41B 11/73 124/80 |
| 2011/0017186 | A1 * | 1/2011 | Gore | F41B 11/645 124/66 |
| 2011/0186026 | A1 * | 8/2011 | Tippmann, Sr. | F41B 11/00 124/73 |

FOREIGN PATENT DOCUMENTS

| | | | |
|---|---|---|---|
| EP | 0460961 | A3 | 9/1993 |
| JP | 04327799 | A | 11/1992 |

* cited by examiner

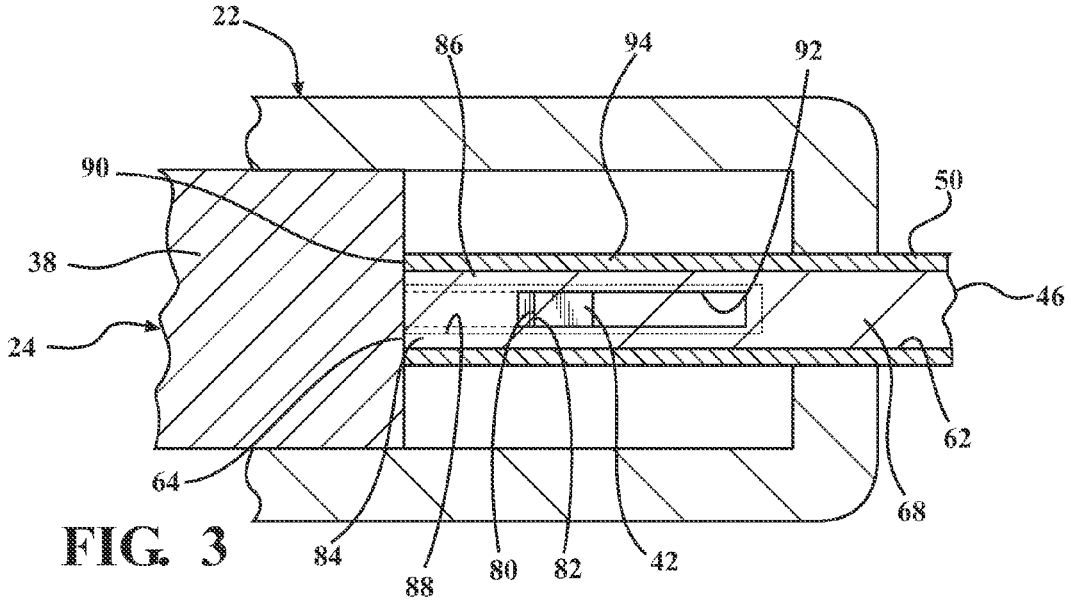
FIG. 3
FIG. 4
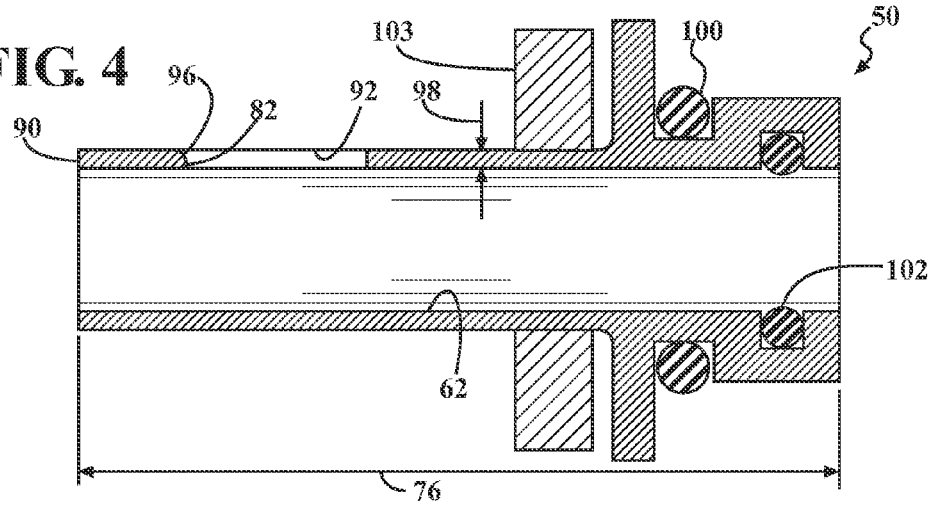
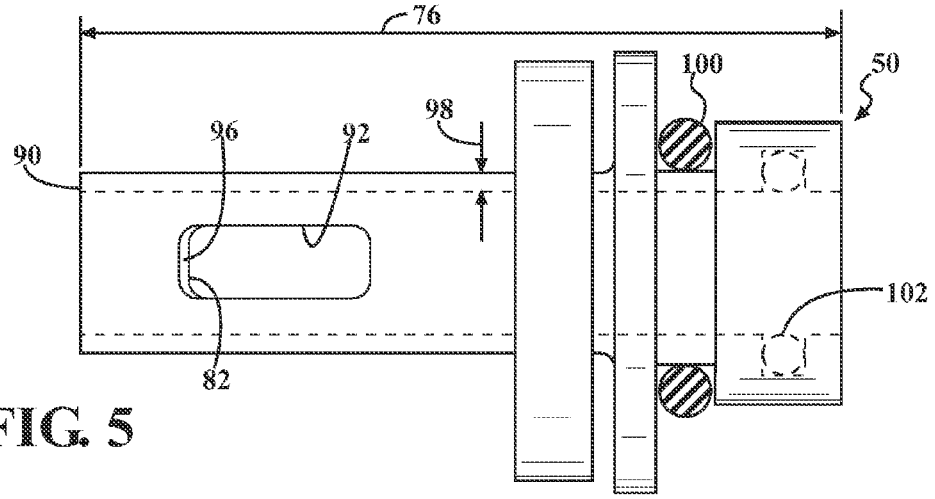
FIG. 5

AIR GUN WITH GAS SPRING ASSEMBLY

CROSS-REFERENCE TO RELATED APPLICATIONS

This application is a continuation in part of U.S. patent application Ser. No. 14/299,321, filed on Jun. 9, 2014.

TECHNICAL FIELD

The disclosure generally relates to an air gun, and more specifically to a gas spring assembly for an air gun.

BACKGROUND

An air gun is a rifle, pistol, etc., which utilizes a compressed gas to fire a projectile. Air guns may be powered by, for example, a coil spring assembly or a gas spring assembly.

Air guns typically include a compression tube that defines a compression chamber, and is attached to a trigger assembly. A barrel is attached to the compression tube and is in fluid communication with the compression chamber. When powered by a coil spring assembly, the coil spring assembly is housed within the compression chamber of the rifle. The coil spring assembly includes a coil spring coupled to a piston. Cocking the gun moves the piston, which compresses the coil spring until a latch on the rear of the piston engages a sear on the trigger assembly. Actuating the trigger assembly releases the sear of the trigger assembly and allows the coil spring to decompress, pushing the piston forward, and thereby compressing the gas, i.e., air, in the compression chamber directly behind the projectile. Once the air pressure rises to a level sufficient to overcome any static friction between the projectile and the barrel, the projectile moves forward within the barrel, propelled by an expanding column of gas.

The coil spring assembly permits use of a center, i.e., an in-line latch, wherein the piston includes a rod that extends along a central, longitudinal axis of the piston. The rod includes the latch which is generally in-line and concentric with a longitudinal axis of the piston. Accordingly, the sear engages the latch substantially in-line with the longitudinal axis of the piston, instead of off-line, radially spaced from the longitudinal axis of the piston, adjacent an outer radial wall of the piston. Such an in-line latching system reduces torque in the spring assembly, which increases the efficiency of the spring assembly and the power of the air gun.

When the air gun is powered by a gas spring assembly, the gas spring assembly is housed within the compression chamber of the rifle. The gas spring assembly includes a piston that defines a sealed interior pressure chamber disposed within the piston. The interior pressure chamber contains a gas, such as air or nitrogen. The piston is slideably disposed over a rod. Cocking the gun moves the piston over the rod, such that the rod displaces the gas within the interior pressure chamber, thereby compressing the gas within the interior pressure chamber, until the latch on the rear of the piston engages the sear on the trigger assembly. Actuating the trigger assembly releases the sear of the trigger assembly and allows the gas spring assembly to decompress, pushing the piston forward, and thereby compressing the gas, i.e., air, in the compression chamber directly behind the projectile. Because the rod is disposed concentric with the piston about the longitudinal axis of the piston, it is difficult to configure an air gun including both an in-line latching system and a gas spring assembly.

SUMMARY

A gas spring assembly for an air gun is provided. The gas spring assembly includes a piston that defines an interior pressure chamber, and includes an annular wall extending along a longitudinal axis between a rearward end and a forward end. The piston includes an end wall disposed adjacent the forward end of the annular wall, and a latch bushing attached to and disposed adjacent the rearward end of the annular wall. The latch bushing defines a central bore that extends along the longitudinal axis. A guide rod is slideably supported within the central bore of the latch bushing. The piston is axially moveable along the longitudinal axis relative to the guide rod, between a compressed position and an un-compressed position. The guide rod includes a first end for engaging a trigger assembly in abutting engagement. The latch bushing includes a ledge that is operable to engage a sear of the trigger assembly in latching engagement when the piston is disposed in the compressed position and the sear is disposed in a cocked position.

The above features and advantages and other features and advantages of the present teachings are readily apparent from the following detailed description of the best modes for carrying out the teachings when taken in connection with the accompanying drawings.

BRIEF DESCRIPTION OF THE DRAWINGS

FIG. 3 is a schematic, enlarged, fragmentary cross sectional view of the air gun, from above, showing a guide rod of the gas spring assembly abutting the trigger assembly.

FIG. 4 is a schematic cross sectional view of the latch bushing of the gas spring assembly.

FIG. 5 is a schematic plan view of the latch bushing.

DETAILED DESCRIPTION

Figure 1:
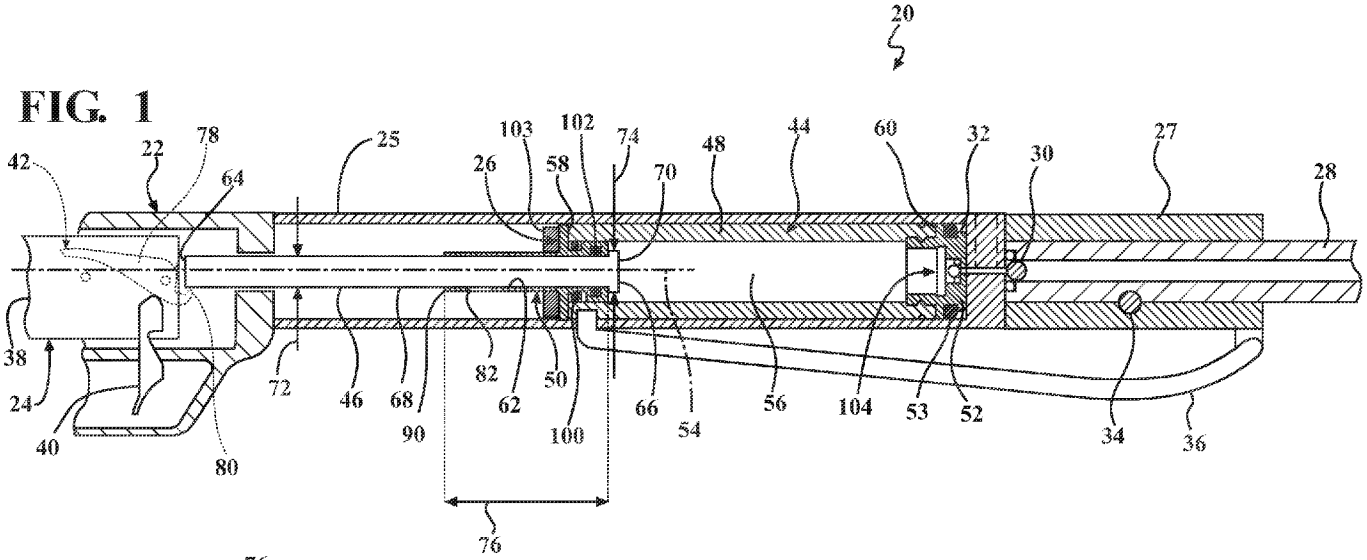
FIG. 1 is a schematic cross sectional view of an air gun, from a first side, showing a gas spring assembly having a piston disposed in an un-compressed position, with a latch bushing of the gas spring assembly de-latched from a sear of a trigger assembly.

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Referring to the Figures, wherein like numerals indicate corresponding parts throughout the several views, an air gun is generally shown at 20. The air gun 20 includes a stock (not shown), a trigger housing 22 supporting a trigger assembly 24, a compression tube 25 supporting a gas spring assembly 26, and a breech block 27 supporting a barrel 28. The compression tube 25 is attached to the trigger housing 22. The breech block 27 is disposed adjacent the compression tube 25. Preferably, the barrel is press fit into or otherwise attached to the breech block 27. The air gun 20 utilizes a burst of compressed air to fire a projectile 30. The air gun 20 shown in FIGS. 1 and 2 may be described as a break barrel style air gun 20. However, it should be appreciated that the teachings of the disclosure may be incorporated into other styles of air guns, such as but not limited to a fixed barrel style air guns.

Figure 2:
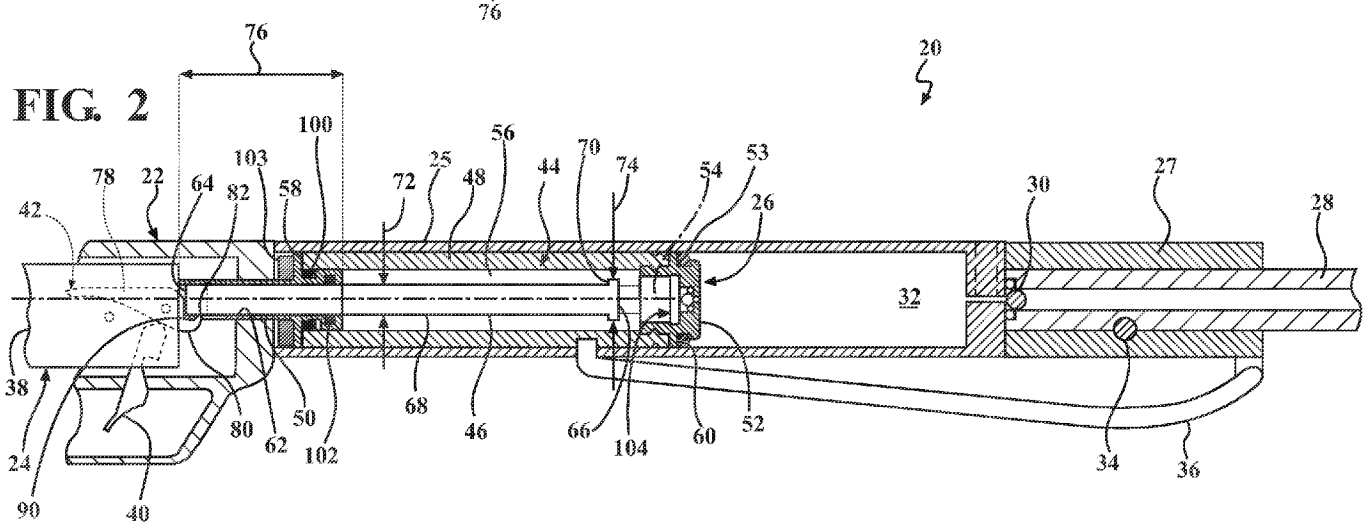
FIG. 2 is a schematic cross sectional view of the air gun, from the first side, showing the piston in a compressed position, with a latch bushing of the gas spring assembly latched to the sear of the trigger assembly.

Referring to FIGS. 1 and 2, the compression tube 25 defines a compression chamber 32, with the gas spring assembly 26 disposed within the compression chamber 32. The compression chamber 32 is in fluid communication with the barrel 28. The breech block 27 and the barrel 28 are pivotable relative to the compression tube 25 about a shaft 34, between a firing position and a cocking position as is well known. A lever 36 interconnects the breech block 27 and the gas spring assembly 26. Movement of the breech block 27 and barrel 28 from the firing position into the cocking position moves the lever 36, which in turn moves the gas spring assembly 26 from an un-compressed position, shown in FIG. 1, into a compressed position, shown in FIG. 2, thereby compressing the gas within the gas spring assembly 26. Movement of the breech block 27 and the barrel 28 from the firing position into the cocking position also moves the trigger assembly 24 from a de-cocked position, shown in FIG. 1, into a cocked position, shown in FIG. 2, and latches the trigger assembly 24 to the gas spring assembly 26. Once the barrel 28 is moved back into the firing position, the air gun 20 is ready to fire.

When the trigger assembly 24 is disposed in the cocked position, with the gas spring assembly 26 disposed in the compressed position, actuation of the trigger assembly 24 releases the gas spring assembly 26, which allows the gas spring assembly 26 to decompress. Decompression of the gas spring assembly 26 compresses the air contained within the compression chamber 32, which fires the projectile 30.

The trigger assembly 24 is housed within and supported by the trigger housing 22. As noted above, the trigger assembly 24 is moveable between the cocked position and the de-cocked position. The cocked position is generally associated with a ready to fire position, and the de-cocked position is generally associated with a post firing, i.e., not-ready to fire position. The trigger assembly 24 may include any trigger assembly 24 commonly known and utilized to fire a weapon. Typically, the trigger assembly 24 includes a housing 38 that supports a trigger 40 and a sear 42. The trigger 40 is engaged to operate the sear 42 through a mechanical connection. However, it should be appreciated that the trigger assembly 24 may be configured in some other manner. When engaged, the sear 42 mechanically latches the gas spring assembly 26 in the compressed position.

Referring to FIGS. 1 and 2, the gas spring assembly 26 includes a piston 44 and a guide rod 46. The piston 44 includes an annular wall 48, a latch bushing 50, and an end wall 52. The guide rod 46 and the piston 44, including the latch bushing 50, the annular wall 48, and the end wall 52, are co-axially and concentrically disposed relative to each other about a longitudinal axis 54. The end wall 52 may include a seal 53 for radially sealing between an outer radial surface of the end wall 52 and an inner radial surface of the compression tube 25. The seal 53 is operable to seal the compression chamber 32 between the end wall 52 and the compression tube 25, while stationary and while the piston 44 is moving relative to the guide rod 46. The seal 53 may include, but is not limited to, a rubber O-ring or other similar device.

The latch bushing 50 may be, but is not required to be, fixedly attached to the annular wall 48 of the piston 44. The piston 44 and the latch bushing 50 are slideably disposed over and moveable along the longitudinal axis 54 relative to the guide rod 46. The guide rod 46 is disposed in abutting engagement with the trigger assembly 24, and remains positionally fixed along the longitudinal axis 54 relative to the trigger assembly 24, with the piston 44 and the latch bushing 50 moving relative to the guide rod 46. As noted above, the piston 44 is moveable between the compressed position and the un-compressed position.

The piston 44 defines an interior pressure chamber 56. The interior pressure chamber 56 is bounded by and defined by the annular wall 48, the end wall 52, and the latch bushing 50. The gas spring assembly 26 includes a pressurized gas, such as air or nitrogen, which is disposed within the interior pressure chamber 56 of the piston 44. The gas spring assembly 26 is configured for compressing the pressurized gas within the interior pressure chamber 56 of the piston 44, in response to movement of the piston 44 from the un-compressed position into the compressed position.

As the piston 44 moves axially along the longitudinal axis 54 relative to the guide rod 46, from the un-compressed position into the compressed position, the piston 44 moves over the guide rod 46 thereby positioning a larger portion of the guide rod 46 within the interior pressure chamber 56. Increasing the volume of the guide rod 46 disposed within the interior pressure chamber 56 decreases the volume within the interior pressure chamber 56 available for the gas disposed within the interior pressure chamber 56, thereby compressing the gas and increasing a fluid pressure of the gas within the interior pressure chamber 56. Compression of the gas within the interior pressure chamber 56 loads the gas spring assembly 26 in preparation for firing the projectile 30 when actuated by the trigger assembly 24.

As noted above, the piston 44 includes the annular wall 48, the end wall 52, and the latch bushing 50. The annular wall 48 extends a length along the longitudinal axis 54, between a rearward end 58 and a forward end 60. The rearward end 58 is disposed nearer a butt end of the stock than is the forward end 60, and the forward end 60 is disposed nearer a muzzle of the barrel 28 than is the rearward end 58. The annular wall 48 is disposed annularly about the longitudinal axis 54, and defines a radial outer boundary of the interior pressure chamber 56. The end wall 52 is disposed adjacent the forward end 60 of the annular wall 48, and defines a forward axial boundary of the interior pressure chamber 56. The latch bushing 50 is disposed adjacent the rearward end 58 of the annular wall 48, opposite of the end wall 52 along the longitudinal axis 54, and defines a rearward axial boundary of the interior pressure chamber 56.

The latch bushing 50 defines a central bore 62, which extends axially along and is concentric with the longitudinal axis 54. The latch bushing 50 is fixedly attached to the annular wall 48 of the piston 44. The latch bushing 50 may be attached to the annular wall 48 in any suitable manner, such as through a threaded connection. Alternatively, the latch bushing 50 may be held in place between a pair of snap rings or other similar devices that are secured to the annular wall 48 of the piston 44 and prevent axial movement of the latch bushing 50 along the longitudinal axis 54 relative to the annular wall 48.

The guide rod 46 is slideably supported within the central bore 62 of the latch bushing 50. The piston 44, including the annular wall 48, the latch bushing 50 and the end wall 52, is axially moveable along the longitudinal axis 54 relative to the guide rod 46, between the un-compressed position shown in FIG. 1, and a compressed position shown in FIG. 2.

The guide rod 46 includes a first end 64 and a second end 66. The first end 64 is disposed rearward of the second end 66, and engages the housing 38 of the trigger assembly 24 in abutting engagement. The second end 66 of the guide rod 46 is disposed within the interior pressure chamber 56 of the piston 44. The guide rod 46 includes a shank portion 68 and a head portion 70. The shank portion 68 includes the first end 64, and extends axially along the longitudinal axis 54. The head portion 70 is disposed at the forward end 60 of the guide rod 46, within the interior pressure chamber 56. The shank portion 68 defines a first diameter 72, and the head portion 70 defines a second diameter 74. The second diameter 74 of the head portion 70 is larger than the first diameter 72 of the shank portion 68. The pressurized gas disposed within the interior pressure chamber 56 biases against the head portion 70 of the guide rod 46, i.e., the second end 66 of the guide rod 46, to bias the second end 66 of the guide rod 46 toward the rearward end 58 of the piston 44. The head portion 70, disposed at the second end 66 of the guide, contacts an interior surface of the latch bushing 50 and prevents the pressurized gas within the interior pressure chamber 56 from completely displacing the guide rod 46 from the central bore 62 of the latch bushing 50.

The first diameter 72 of shank portion 68 of the guide rod 46 is substantially equal to a bore diameter of the central bore 62 of the latch bushing 50. However, it should be appreciated that the bore diameter of the central bore 62 of the latch bushing 50 will be slightly larger than the first diameter 72 of the shank portion 68 to provide sufficient clearance to allow relative movement of the latch bushing 50 over the guide rod 46. However, the clearance between the central bore 62 of the latch bushing 50 and the shank portion 68 of the guide rod 46 should be minimized so that the latch bushing 50 may radially support the guide rod 46.

The latch bushing 50 includes a bushing length 76 measured along the longitudinal axis 54. The latch bushing 50 radially supports the guide rod 46 along the entire bushing length 76 of the latch bushing 50. Radially supporting the guide rod 46 along the entire bushing length 76 of the latch bushing 50 reduces relative flexure or bending between the piston 44 and the guide rod 46, which increases the efficiency of the gas spring assembly 26.

As noted above, and with reference to FIGS. 1 through 3, the trigger assembly 24 includes a housing 38 supporting a sear 42. Preferably, and as shown, the sear 42 includes a planar portion 78, which presents a catch 80 for engaging a ledge 82 on the latch bushing 50 in latching engagement. The planar portion 78, including the catch 80, generally moves in a vertical direction, along a plane of the planar portion 78, as the trigger assembly 24 is moved from the de-cocked position into the cocked position.

Referring to FIG. 3, the first end 64 of the guide rod 46 includes a first arm portion 84 and a second arm portion 86, each extending along the longitudinal axis 54 to a respective distal end, and cooperating to define a slot 88 therebetween. The first end 64 of the guide rod 46 is disposed in abutting engagement with the housing 38 of the trigger assembly 24. More specifically, the distal ends of the first arm portion 84 and the second arm portion 86 engage the housing 38 of the trigger assembly 24 in abutting engagement. When the sear 42 is disposed in the cocked position, the planar portion 78 of the sear 42, including the catch 80, is at least partially disposed within the slot 88, between the first arm portion 84 and the second arm portion 86. Accordingly, the slot 88 provides the space or clearance necessary for the planar portion 78 of the sear 42, including the catch 80 to move into the cocked position. If not for the presence of the slot 88, the planar portion 78 of the sear 42 would be blocked from moving into the cocked position by the first end 64 of the guide rod 46.

Referring to FIGS. 4 and 5, the latch bushing 50 includes a contact end 90 that is axially spaced, along the longitudinal axis 54, from the rearward end 58 of the annular wall 48 of the piston 44. Referring to FIG. 2, the contact end 90 of the latch bushing 50 contacts the sear 42 at an axial location along the longitudinal axis 54 that is disposed rearward of the catch 80 of the sear 42. The latch bushing 50 defines the ledge 82 for engaging the catch 80 of the sear 42 in latching engagement. Preferably, and as shown in FIGS. 4 and 5, the latch bushing 50 defines a window 92 extending through an outer wall 94 of the latch bushing 50, into the central bore 62 of the latch bushing 50. The window 92 includes an edge 96, which is defined by a thickness 98 of the outer wall 94. The edge 96 of the window 92 defines the ledge 82 for engaging the catch 80 of the sear 42 in latching engagement. Preferably, the ledge 82 is disposed nearer the longitudinal axis 54 than the annular wall 48 of the piston 44, so as to form an in-line latching system.

As shown in FIG. 1, the contact end 90 of the latch bushing 50 is de-coupled from the sear 42 of the trigger assembly 24 when the trigger assembly 24 is in the de-cocked position and the piston 44 is in the un-compressed position. As shown in FIG. 2, the contact end 90 of the latch bushing 50 is releasably coupled to the sear 42 of the trigger assembly 24 when the trigger assembly 24 is in the cocked position, and the piston 44 is in the compressed position. Axial movement of the piston 44 along the longitudinal axis 54, from the un-compressed position into the compressed position, brings the contact end 90 of the latch bushing 50 into pressing engagement with the sear 42, and moves the sear 42 from the de-cocked position into the cocked position. As the sear 42 moves from the de-cocked position into the cocked position, the catch 80 of the sear 42 engages the ledge 82 in latched engagement to secure the piston 44 within the compression chamber 32 relative to the trigger housing 22.

Referring to FIGS. 1 and 2, movement of the piston 44 from the un-compressed position, shown in FIG. 1, into the compressed position, shown in FIG. 2, brings the contact end 90 of the latch bushing 50 into latching engagement with the sear 42 of the trigger assembly 24. Actuation of the trigger assembly 24 from the cocked position to the de-cocked position de-couples the latch bushing 50 from the sear 42 of the trigger assembly 24. De-coupling the sear 42 of the trigger assembly 24 from the latch bushing 50 permits the compressed air within the interior pressure chamber 56 to decompress or expand the gas spring assembly 26, which moves the piston 44 along the longitudinal axis 54, thereby compressing the air within the compression chamber 32, which in turn propels the projectile 30 out of the barrel 28.

Referring to FIGS. 1 and 2, the gas spring assembly 26 includes a static seal 100, which is disposed between the piston 44 and latch bushing 50. The static seal 100 is operable to seal the interior pressure chamber 56, between the piston 44 and the latch bushing 50. The static seal 100 is coupled to an exterior surface of the latch bushing 50, and engages an interior surface of the piston 44. The static seal 100 may include any device capable of sealing between the piston 44 and latch bushing 50, such as but not limited to a rubber O-ring/gasket or similar device. Furthermore, the static seal 100 may include multiple devices positioned axially adjacent each other along the longitudinal axis 54.

The gas spring assembly 26 further includes a dynamic seal 102. The dynamic seal 102 is disposed between an interior surface of the central bore 62 of the latch bushing 50 and the guide rod 46. The dynamic seal 102 is operable to seal the interior pressure chamber 56 between the latch bushing 50 and the guide rod 46. The dynamic seal 102 must seal between the latch bushing 50 and the guide rod 46, while stationary and while the latch bushing 50 is moving relative to the guide rod 46. The dynamic seal 102 may include, but is not limited to, a rubber 0-ring or other similar device.

As noted above, the latch bushing 50 includes a bushing length 76 that is measured along the longitudinal axis 54. The bushing length 76 of the latch bushing 50 may be used to control the displacement of the guide rod 46 within the interior pressure chamber 56 of the gas spring assembly 26. As such, a spring force generated by the gas spring assembly 26, when disposed in the compressed position, may be dependent upon the bushing length 76 of the latch bushing 50. While the latch bushing 50 is shown as a single manufacture, including both the dynamic seal 102 and the static seal 100, it should be appreciated that the latch bushing 50 may be manufactured from two separate components, a first component that is fixedly attached to the annular wall 48 of the piston 44 and includes the static seal 100, and a second component that includes a tubular portion that defines the central bore 62 and includes the dynamic seal 102. In so doing, the spring force of the gas spring assembly 26 may be easily changed by replacing the second component with a tubular portion of a different bushing length 76. Furthermore, it should be appreciated that the latch bushing 50 may be configured differently than shown and described herein.

As shown in FIGS. 1-2, 4-5, and 8, the air gun 20 may also include a damping/support bushing 103. The damping/support bushing 103 is disposed annularly about the tubular portion of the latch bushing 50, adjacent the rearward end 58 of the annular wall 48 of the piston 44. The damping/support bushing 50 is disposed in radial contact with an inner surface of the compression tube 25, about the longitudinal axis 54. The damping/support bushing 103 is manufactured from a material capable of both damping vibration in the gas spring assembly 26, as well as radially support the latch bushing 50 and the guide rod 46 relative to the longitudinal axis 54. The material of the damping/support bushing 103 should also include a low coefficient of friction to minimize frictional forces between the damping/support bushing 103 and the compression tube 25. The damping/support bushing supports the latch bushing 50 to promote smooth, in-line movement during engagement of the latch bushing 50 with the trigger assembly 24, and during the firing cycle. Consistent, in-line movement of the latch bushing 50 and the guide rod 46 provides a linear firing cycle along the longitudinal axis 54, which increases output performance of the air gun 20, and reduces shot velocity variations. Additionally, the damping/support bushing 103 dampens harmonic noise created by the gas spring assembly 26 when the piston 44 slams forward during the firing cycle.

Figure 6:
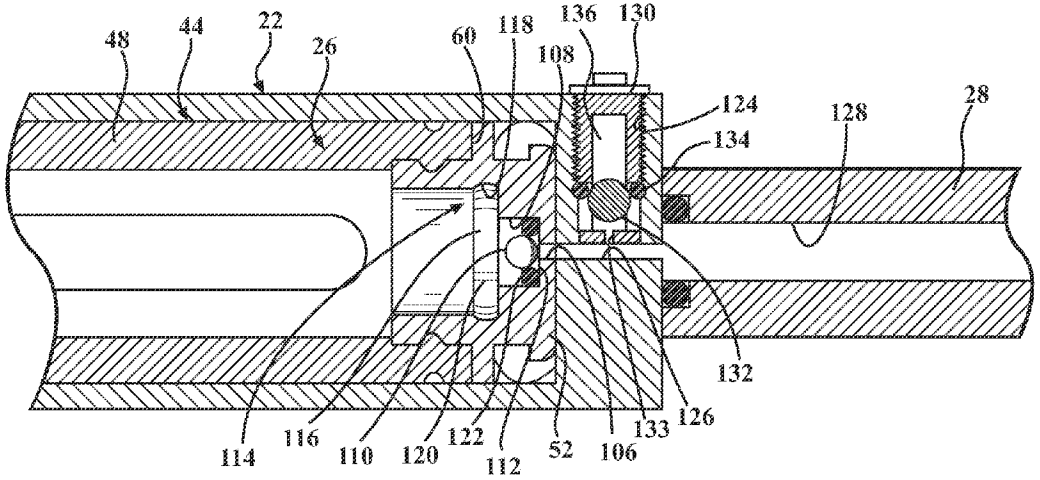
FIG. 6 is a schematic, enlarged, fragmentary cross sectional view of the air gun, from above, showing a charging valve system of the gas spring assembly.
Figure 7:
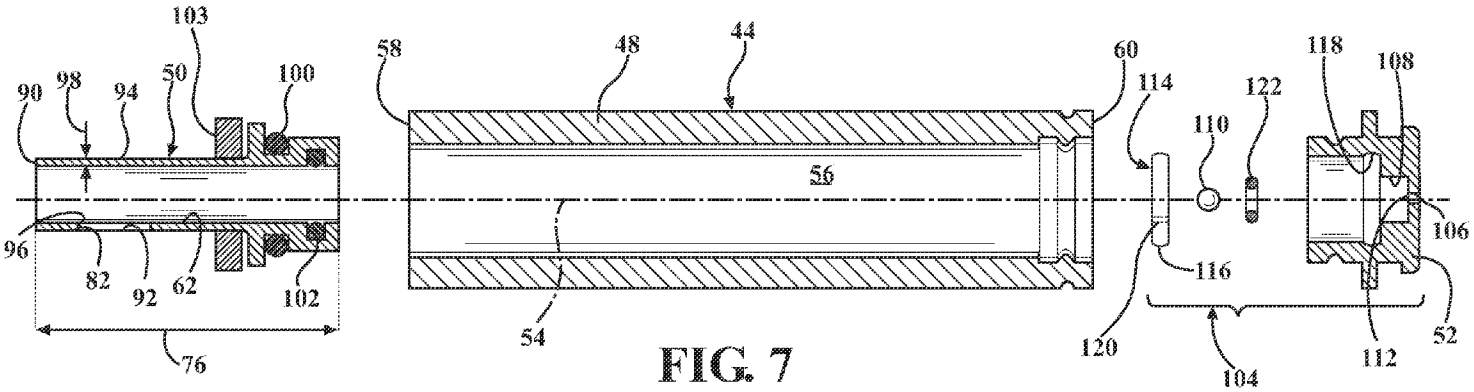
FIG. 7 is a schematic exploded cross sectional view of the piston of the gas spring assembly showing the charging valve system.

Referring to FIGS. 6 and 7, the piston 44 includes a charging valve system 104. When a fluid pressure in the compression chamber 32 is greater than a fluid pressure in the interior pressure chamber 56 of the gas spring assembly 26, the charging valve system 104 is automatically operated to open fluid communication between the interior pressure chamber 56 and the compression chamber 32. The charging valve system 104 opens fluid communication to allow fluid, e.g., air or nitrogen, to flow into of the interior pressure chamber 56 of the gas spring assembly 26, thereby increasing the fluid pressure within the interior pressure chamber 56. When the fluid pressure in the compression chamber 32 is equal to or less than the fluid pressure in the interior pressure chamber 56, the charging valve system 104 automatically operates to close fluid communication between the interior pressure chamber 56 of the gas spring assembly 26 and the compression chamber 32, to prevent fluid from escaping the interior pressure chamber 56 of the gas spring assembly 26 and maintain the fluid pressure within the interior pressure chamber 56. The charging valve system 104 may be manually operated to open fluid communication between the interior pressure chamber 56 of the gas spring assembly 26 and the compression chamber 32, to allow fluid to escape from within the interior pressure chamber 56 to decrease the fluid pressure within the interior pressure chamber 56.

As shown in the Figures, the charging valve system 104 is disposed in the end wall 52 of the piston 44. The charging valve system 104 includes a piston port 106, which extends through the end wall 52 of the piston 44, into an interior pocket 108 defined by the end wall 52 and disposed within the interior pressure chamber 56. A ball 110 is disposed within the interior pocket 108 of the end wall 52. The ball 110 is seated adjacent an interior rim 112 of the piston port 106. The ball 110 is operable to block fluid communication through the piston port 106.

A retaining mechanism 114 is positioned within the interior pressure chamber 56 and operable to secure the ball 110 within the interior pocket 108. The retaining mechanism 114 may include, for example, an annular plate 116 having a circumference sized to snuggly fit within an undercut 118 formed into the interior surface of the end wall 52. The annular plate 116 may be manufactured from a plastic, so that it may be temporarily and elastically deformed during insertion into the undercut 118. The annular plate 116 includes at least one aperture 120 extending therethrough to allow fluid communication through the annular plate 116, between the interior pressure chamber 56 and the pocket of the end wall 52. The annular plate 116 is positioned adjacent the ball 110 a distance sufficient to allow the ball 110 to move axially along the longitudinal axis 54 to open fluid communication to the piston port 106, while preventing the ball 110 from becoming dislodged from the pocket of the end wall 52.

The charging valve system 104 may include a port seal 122. The port seal 122 is disposed between the end wall 52 and the ball 110, around the interior rim 112 of the piston port 106. The port seal 122 is operable to seal between the ball 110 and the end wall 52. The port seal 122 guides the ball 110 into seated engagement with the piston port 106 to block the piston port 106. The port seal 122 may include any suitable seal, such as but not limited to a rubber o-ring or other similar device. The port seal 122 includes an outer circumference that is substantially equal to a circumference of the interior pocket 108 in the end wall 52, such that the port seal 122 remains secured in place by friction contact with the interior pocket 108.

When the fluid pressure within the compression chamber 32 is greater than the fluid pressure within the interior pressure chamber 56 of the piston 44, thereby creating a pressure differential, the ball 110 is automatically unseated from the interior rim 112 of the piston port 106 and moved axially along the longitudinal axis 54 away from the piston port 106. Unseating the ball 110 allows or opens fluid communication between the compression chamber 32 and the interior pressure chamber 56. When the fluid pressure within the interior pressure chamber 56 of the piston 44 is equal to or greater than the fluid pressure within the compression chamber 32, the pressure differential therebetween automatically seats the ball 110 against the port seal 122 and the interior rim 112 of the piston port 106, to seal the interior pressure chamber 56 and prevent fluid communication between the interior pressure chamber 56 and the compression chamber 32. When the fluid pressure within the interior pressure chamber 56 of the piston 44 is equal to or greater than the fluid pressure within the compression chamber 32, the ball 110 may be manually moved away from the piston port 106 and the port seal 122 to open fluid communication through the piston port 106 and allow fluid to escape from the interior pressure chamber 56. The ball 110 may be manually moved, for example, by inserting a small diameter tool, such as a pin or wire, through the piston port 106 and pressing the ball 110 away from the piston port 106 and against the annular plate 116 of the retaining mechanism 114.

Referring to FIG. 6, the compression tube 25 may define a pressure port 124 disposed in fluid communication with the compression chamber 32. As shown, the pressure port 124 is disposed in fluid communication with a firing port 126. The firing port 126 connects the compression chamber 32 and a bore 128 of the barrel 28 in fluid communication. The pressure port 124 is in fluid communication with the compression chamber 32 through the firing port 126. The pressure port 124 is operable to introduce a pressurized gas into the compression chamber 32.

A pressurized gas valve fitting 130 may be disposed in the pressure port 124. The pressurized gas valve fitting 130 is operable or moveable between a sealed position and a release position. When disposed in the sealed position, the pressurized gas valve fitting 130 seals the pressure port 124. When disposed in the release position, the pressurized gas valve fitting 130 allows fluid communication through the pressure port 124. The pressurized gas valve fitting 130 may include, but is not limited to, a Schrader valve, a Presta valve, or some other valve device.

In order to allow the introduction of pressurized gas into the compression chamber 32, and prevent the pressurized gas from escaping the pressure chamber 32, the pressurized gas valve fitting 130 may include a ball 132 seated against a rim 133 of the pressure port 124. A seal 134, such as an o-ring or other similar device seals between the wall of the pressure port 124 and a shank portion 136 of the pressurized gas valve fitting 130. The seal 134 is disposed between the ball 132 and the shank portion 136 of the pressurized gas valve fitting 130. Pressurized gas that is introduced into the compression chamber 32 via the pressurized gas valve fitting urges the ball 132 away from the seal 134, i.e., into the release position, thereby allowing the pressurized gas to flow around the ball and through the rim 133 of the of the pressure port 124. Pressurized gas from within the compression chamber 32 urges the ball 132 into sealing engagement with the seal 134, i.e., the sealed position, thereby preventing the escape of the pressurized gas from the compression chamber 32.

When the pressurized gas valve fitting 130 is disposed in the release position, pressurized gas, from a pressure source such as but not limited to a compressed gas cylinder or a pump, may be introduced into the compression chamber 32 through the pressurized gas valve fitting 130. Introducing the pressurized gas into the compression chamber 32 increases the fluid pressure within the compression chamber 32. If the fluid pressure within the compression chamber 32 is increased to a level greater than the fluid pressure within the interior pressure chamber 56 of the gas spring assembly 26, the charging valve system 104 will automatically open and allow the pressurized gas within the compression chamber 32 to flow into the interior pressure chamber 56, thereby increasing the fluid pressure within the interior pressure chamber 56 of the gas spring assembly 26, while the gas spring assembly 26 is disposed within the compression chamber 32 of the trigger housing 22. When the pressurized gas source is removed and the pressure within the compression chamber 32 falls below that fluid pressure within the interior pressure chamber 56 of the gas spring assembly 26, the charging valve system 104 closes, thereby retaining the gas within the interior pressure chamber 56 and maintaining the fluid pressure of the gas spring assembly 26. It should be appreciated that in the exemplary embodiment shown, the firing port 126 must be blocked and/or plugged in order to introduce the pressurized gas into the compression chamber 32 via the pressure port 124.

Figure 8:
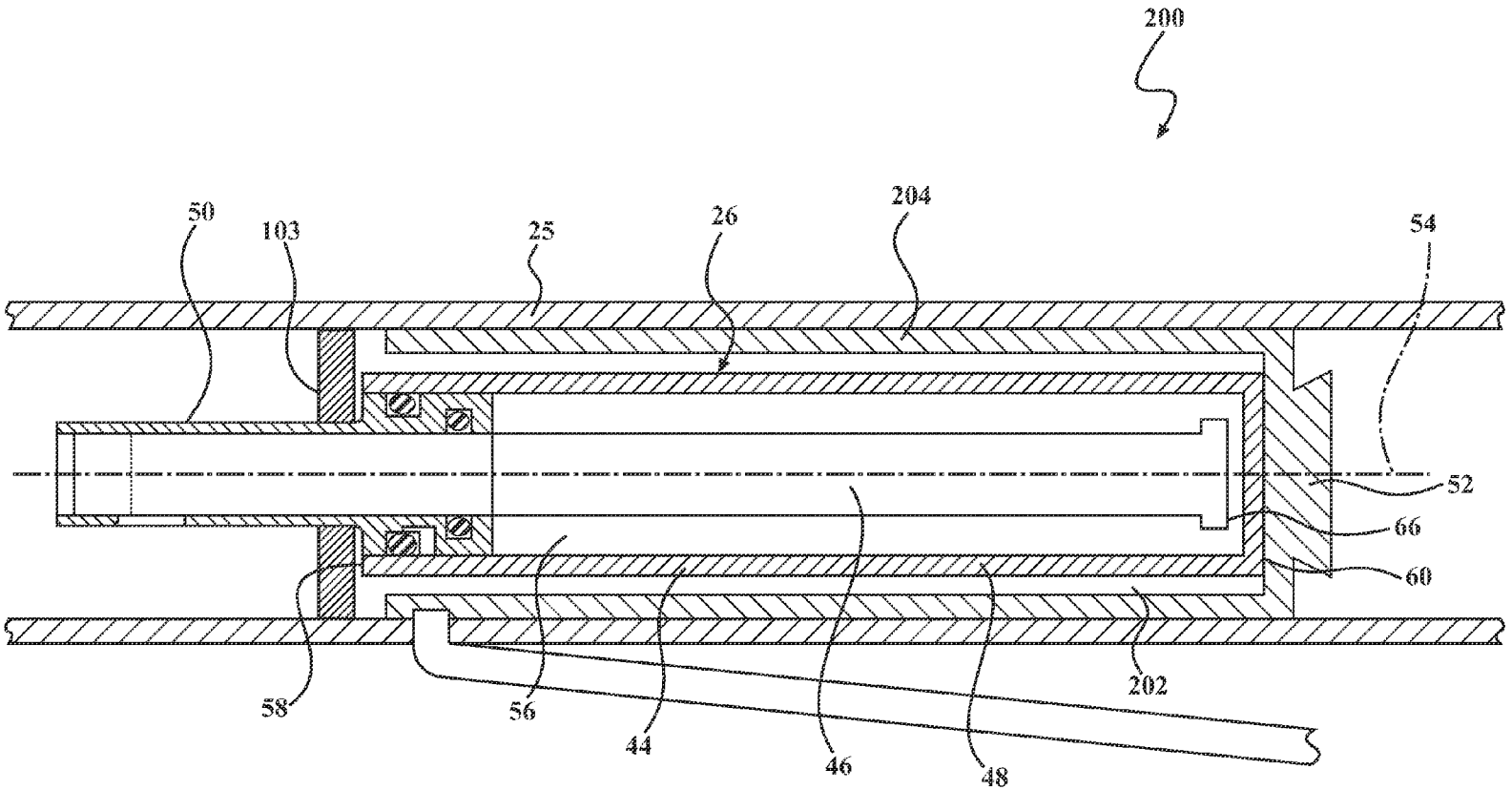
FIG. 8 is a fragmentary, schematic cross section view of an alternative embodiment of the air gun, from the first side.

Referring to FIG. 8, an alternative embodiment of the air gun is generally shown at 200. Throughout FIG. 8, features and components that are common to the embodiment of the air gun 20 shown in FIGS. 1 through 7 are identified with the same reference numerals used in FIGS. 1 through 7. As shown in FIG. 8, the gas spring assembly 26 is disposed within an interior chamber 202 of an outer piston 204. The air gun 200 generally operates in the same manner as the air gun 20 described above. The difference between the first embodiment of the air gun 20 and the alternative embodiment of the air gun 200 is that the lever 36 is coupled to the outer piston 204, such that movement of the barrel 28 between the firing position and the cocking position directly moves the outer piston 204. Movement of the outer piston 204 thereby moves the piston 44 of the gas spring assembly 26 from the uncompressed position into the compressed position, the compressed position being shown in FIG. 8, thereby compressing the gas within the gas spring assembly 26. As is described above in relation to the first embodiment of the air gun 20, movement of the gas spring assembly 26 into the compressed position also moves the trigger assembly 24 from the decocked position into the cocked position, and latches the trigger assembly 24 to the gas spring assembly 26.

The alternative embodiment of the air gun 200 may be manufactured by converting an existing coil spring assembly, to use a mass produced gas spring assembly 26, such that the piston 44 of the gas spring assembly 26 does not need to be exactly sized to the specific internal dimensions of the compression tube 25. Rather, the gas spring assembly 26 is merely positioned inside the already existing piston, i.e., the piston 204 of the previous coil spring assembly. As such, it should be appreciated that the outer piston 204 may have been the piston of a pre-existing coil spring assembly. Upon firing the rifle, the piston 44 of the gas spring assembly 26 moves along the longitudinal axis, and pushes the outer piston 204 forward, thereby compressing the gas within the compression chamber 32, and firing the projectile 30 as described above.

Figure 9:
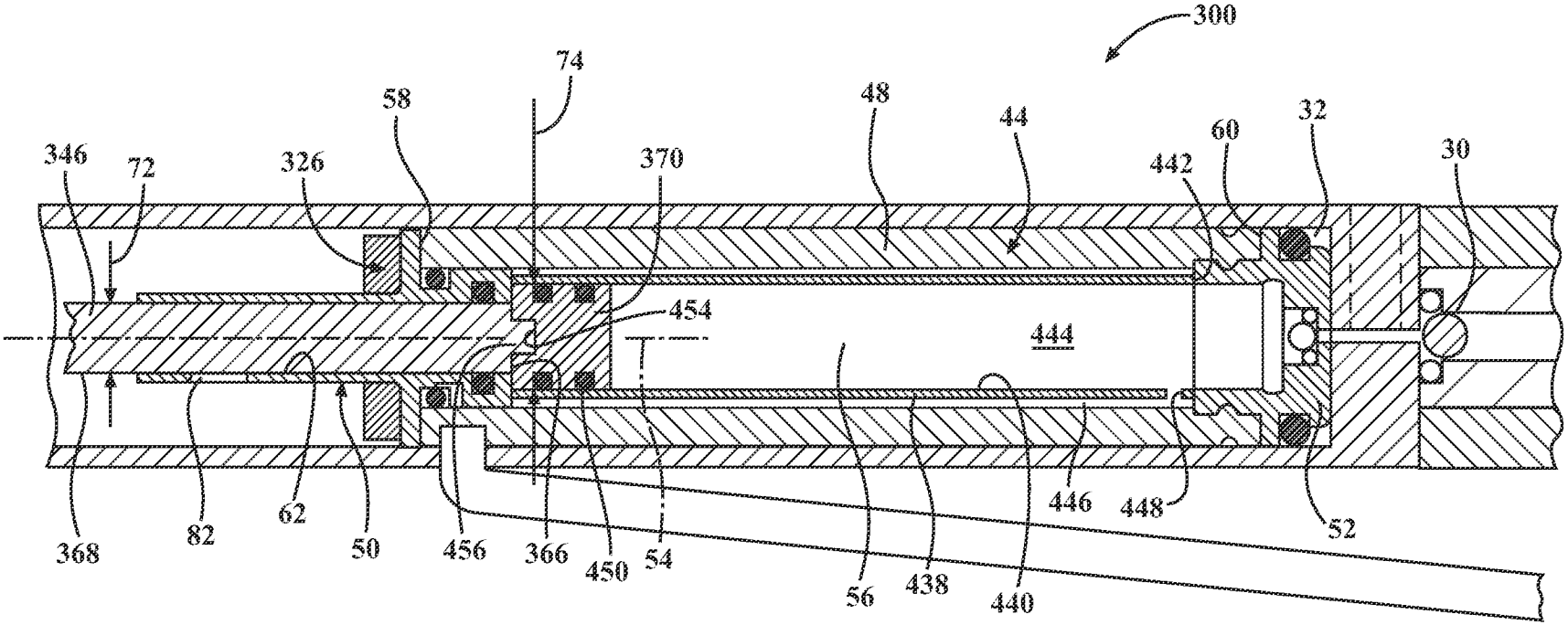
FIG. 9 is a fragmentary, schematic cross section view of another alternative embodiment of the air gun, from the first side.

Referring to FIG. 9, an alternative embodiment of the air gun is generally shown at 300. Throughout FIG. 9, features and components that are common to the embodiment of the air gun 20 shown in FIGS. 1 through 7 are identified with the same reference numerals used in FIGS. 1 through 7. The embodiment of the air gun 300 shown in FIG. 9 differs from the air gun 20 shown in FIGS. 1 through 7 in the construction of the gas spring assembly 326. Briefly, the gas spring assembly 326 includes a shank portion 368 of a guide rod 346 separate from a head portion 370, and includes an inner support tube 438 disposed within the interior pressure chamber 56 of the piston 44 for supporting the head portion 370.

Referring to FIG. 9, the gas spring assembly 326 includes the piston 44, including the annular wall 48 and the end wall 52 that at least partially define the interior pressure chamber 56, and the latch bushing 50 attached to the annular wall 48 adjacent the rearward end of the annular wall 48 to further define the interior pressure chamber 56, as set forth and described above with reference to FIGS. 1 through 7.

The inner support tube 438 is disposed within the interior pressure chamber 56 of the piston 44. The inner support tube 438 is axially and radially supported by the latch bushing 50 and the end wall 52 respectively, to limit axial and radial movement of the inner support tube 438 relative to the longitudinal axis 54 and/or the piston 44. The inner support tube 438 may be radially supported by the latch bushing 50 and/or the end wall 52 via an undercut or other similar annular support structure within which the inner support tube 438 is supported. The inner support tube 438 defines an inner bore 440 that extends along the longitudinal axis 54, between the latch bushing 50 and the end wall 52. The inner bore 440 of the inner support tube 438 is concentric with the central bore 62 of the latch bushing 50. A forward end 442 of the inner support tube 438 is disposed against the end wall 52 of the piston 44. However, even though the forward end 442 of the inner support tube 438 abuts the end wall 52 of the piston 44, the abutting engagement does not form a seal, and therefore, the forward end 44 is not sealed against the end wall 52 of the piston 44. Because the forward end 44 is not sealed against the end wall 52 of the piston 44, pressurized gas may flow between a portion 444 of the interior pressure chamber 56 defined by the inner bore 440 of the inner support tube 438, and a portion 446 of the interior pressure chamber 56 defined between the inner support tube 438 and an interior surface of the annular wall 48.

The inner support tube 438 may optionally include a bleed port 448 that extends radially through the inner support tube 438, so that gas may flow between the portion 444 of the interior pressure chamber 56 defined by the inner bore 440 of the inner support tube 438, and the portion 446 of the interior pressure chamber 56 defined between the inner support tube 438 and the interior surface of the annular wall 48.

The head portion 370 is disposed within the inner bore 440 of the inner support tube 438. The head portion 370 is moveable within the inner bore 440 relative to the inner support tube 438 and the piston 44. The head portion 370 is axially moveable along the longitudinal axis 54. The gas spring assembly 326 may include a dynamic head seal 450 that is disposed between the head portion 370 and the inner support tube 438. The dynamic head seal 450 is operable to seal between an interior radial surface of the inner support tube 438 and an exterior radial surface of the head portion 370.

The guide rod 346 is slideably supported within the central bore 62 of the latch bushing 50. The guide rod 346, the latch bushing 50, the piston 44, the head portion 370, and the inner support tube 438 are all co-axially disposed relative to each other along the longitudinal axis 54. As described above related to the embodiment of the air gun 20 shown in FIGS. 1 through 7, the piston 44 is axially moveable along the longitudinal axis 54 relative to the guide rod 346 between the compressed position and the un-compressed position.

Similar to the guide rod 46 shown in FIGS. 1 through 7, the guide rod 346 includes the first end 64 (not shown in FIG. 9) for engaging the trigger assembly 24 in abutting engagement. Additionally, the guide rod 346 includes a second end 366. However, whereas the guide rod 46 shown in the embodiment of the air gun 20 shown in FIGS. 1 through 7 included the head portion 70, the second end 366 of the guide rod 346 shown in FIG. 9 does not include the head portion 70 integrally formed therewith. Rather, the second end 366 of the guide rod 346 shown in FIG. 9 engages the separate and independent head portion 370 within the inner bore 440 of the inner support tube 438. Accordingly, the guide rod 346 and the head portion 370 are separate and distinct components of the air spring assembly, and are not attached together, which is the primary difference between the embodiment of the air gun 20 shown in FIGS. 1 through 7, and the embodiment of the air gun 300 shown in FIG. 9. The head portion 370 may define a recess 454, and the guide rod 346 may include a projection 456 sized to fit within the recess 454. The projection 456 is seated within the recess 454.

The guide rod 346 includes a shank portion 368 defining a first diameter 72. The shank portion 368 is disposed adjacent the second end 366 of the guide rod 346. The first diameter 72 is substantially equal to the diameter of the central bore 62 of the latch bushing 50, so that the guide rod 346 may be inserted and/or withdrawn through the central bore 62 of the latch bushing 50. The head portion 370 defines the second diameter 74. The second diameter 74 of the head portion 370 is larger than the first diameter 72 of the shank portion 368, and is larger than the diameter of the central bore 62, such that the head portion 370 may not pass through the central bore 62.

The second end 366 of the guide rod 346 engages the head portion 370 to bias against the head portion 370 as the piston 44 is moved from the un-compressed position into the compressed position. With the guide rod 346 biasing against the head portion 370 as the piston 44 is moved, the piston 44 and the inner support tube 438 move relative to the head portion 370 axially along the longitudinal axis 54, such that the head portion 370 moves within the inner bore 440 of the inner support tube 438. As described above relative to the embodiment of the air gun 20 shown in FIGS. 1 through 7, as the head portion 370 is moved further into the interior pressure chamber 56, the gas within the interior pressure chamber 56 is compressed by the displacement caused by the guide rod 346 within the interior pressure chamber 56. As the head portion 370 is moved relative to the inner support tube 438, and the gas within the inner bore 440 of the inner support tube 438 is compressed, the gas bleeds or flows around the forward end 442 of the inner support tube 438, between the forward end 442 of the inner support tube 438 and the end wall 52, and/or flows through the bleed port 448, into the portion 446 of the interior pressure chamber 56 disposed between the annular wall 48 and the inner support tube 438.

The force generated by the gas spring assembly 326 is dependent upon the volume of the pressurized gas contained within the interior pressure chamber 56 of the piston 44. Accordingly, by changing an axial length of the head portion 370, or a wall thickness of the inner support tube 438, for example, the volume of gas within the interior pressure chamber 56 may be reduced or increased, thereby decreasing or increasing the force generated by the gas spring assembly 326 respectively.

The speed of the piston 44 during firing may also be controlled, by changing the cross sectional area of the bleed port 448, or a space between the forward end 442 of the inner support tube 438 and the end wall 52. When the air gun 20 is fired, the piston 44 moves forward, away from the forward end 442 of the inner support tube 438. In order to allow the piston 44 to move forward, gas, e.g., air, must be able to flow into the portion 444 of the interior pressure chamber 56 defined by the inner bore 440 of the inner support tube 438, in order to prevent the formation of a vacuum that would prevent the piston 44 from moving. The size or area of the bleed portion 448, and/or the distance or space between the forward end 442 of the inner support tube 438 and the end wall 52 controls how fast the gas may flow into the portion 444 of the interior pressure chamber 56. An increase in the area increases the rate at which the gas may flow into the portion 444 of the interior pressure chamber 56, which allows the piston 44 to move faster. A decrease in the flow area decreases the rate at which the gas may flow into the portion 444 of the interior pressure chamber 56, which slows the speed of the piston 44. The speed of the piston 44 affects the speed of the projectile 30 when fired. For a given caliber and weight of the projectile 30, an increase in the speed of the piston 44 when fired increases the fired velocity of the projectile 30. In contrast, for a given caliber and weight of the projectile, a decrease in the speed of the piston 44 when fired decreases the fired velocity of the projectile 30. Accordingly, the gas spring assembly 326 provides yet another advantageous method of tailoring or tuning the operation of the air gun 20 to achieve optimum performance.

Additionally, because the guide rod 346 is not attached to the head portion 370, the guide rod 346 may be shipped separately from the pressurized piston 44, and then simply inserted through the central bore 62 of the latch bushing 50, and into abutting engagement with the head portion 370 to assemble the gas spring assembly 326, prior to installation into the air gun 300.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. A gas spring assembly configured for an air gun, the gas spring assembly comprising:

a piston defining an interior pressure chamber, and including an annular wall extending along a longitudinal axis between a rearward end and a forward end, and an end wall disposed adjacent the forward end of the annular wall;

a latch bushing attached to and disposed adjacent the rearward end of the annular wall, and defining a central bore extending along the longitudinal axis;

a guide rod slideably supported within the central bore of the latch bushing, with the piston axially moveable along the longitudinal axis relative to the guide rod between a compressed position and an un-compressed position;

wherein the guide rod includes a first end for engaging a trigger assembly in abutting engagement; and wherein the latch bushing includes a ledge operable to engage a sear of the trigger assembly in latching engagement when the piston is disposed in the compressed position and the sear is disposed in a cocked position.

2. The gas spring assembly set forth in claim 1 further comprising an inner support tube disposed within the interior pressure chamber of the piston and defining an inner bore extending along the longitudinal axis between the latch bushing and the end wall.

3. The gas spring assembly set forth in claim 2 further comprising a head portion disposed within the inner bore of the inner support tube and moveable within the inner bore relative to the inner support tube, along the longitudinal axis.

4. The gas spring assembly set forth in claim 3 wherein the guide rod includes a second end for engaging the head portion within the inner bore of the inner support tube.

5. The gas spring assembly set forth in claim 2 wherein the inner support tube is axially and radially supported by the latch bushing and the end wall to limit axial and radial movement of the inner support tube relative to the longitudinal axis.

6. The gas spring assembly set forth in claim 5 wherein a forward end of the inner support tube is not sealed against the end wall, such that gas may flow between a portion of the interior pressure chamber defined by the inner bore and a portion of the interior pressure chamber defined between the inner support tube and an interior surface of the annular wall.

7. The gas spring assembly set forth in claim 2 wherein the inner support tube includes a bleed port extending radially through the inner support tube such that gas may flow between a portion of the interior pressure chamber defined by the inner bore and a portion of the interior pressure chamber defined between the inner support tube and an interior surface of the annular wall.

8. The gas spring assembly set forth in claim 3 wherein the head portion defines a recess, and the guide rod includes a projection sized to fit within the recess, with the projection seated within the recess.

9. The gas spring assembly set forth in claim 3 further comprising a dynamic head seal disposed between the head portion and the inner support tube, and operable to seal between an interior radial surface of the inner support tube and an exterior radial surface of the head portion.

10. The gas spring assembly set forth in claim 1 wherein the latch bushing includes a contact end axially spaced, along the longitudinal axis, from the rearward end of the annular wall of the piston, wherein axial movement of the piston along the longitudinal axis from the un-compressed position into the compressed position is operable to bring the contact end of the latch bushing into pressing engagement with the sear, and to move the sear from the de-cocked position into the cocked position, with the sear engaging the ledge in latched engagement to secure the piston.

11. The gas spring assembly set forth in claim 1 wherein the first end of the guide rod includes a first arm portion and a second arm portion, each extending along the longitudinal axis and cooperating to define a slot therebetween.

12. The gas spring assembly set forth in claim 1 wherein the latch bushing defines a window extending through an outer wall into the central bore of the latch bushing, wherein the window includes an edge defined by a thickness of the outer wall, with the edge of the window defining the ledge.

13. The gas spring assembly set forth in claim 1 wherein the gas spring assembly includes a static seal disposed between the latch bushing and an interior surface of the annular wall of the piston, wherein the static seal is operable to seal the interior pressure chamber between the piston and the latch bushing.

14. The gas spring assembly set forth in claim 13 wherein the gas spring assembly includes a dynamic seal disposed between an interior surface of the central bore of the latch bushing and the guide rod, wherein the dynamic seal is operable to seal the interior pressure chamber between the latch bushing and the guide rod.

15. The gas spring assembly set forth in claim 3 wherein the guide rod includes a shank portion defining a first diameter, the head portion defines a second diameter, and wherein the second diameter is larger than the first diameter.

16. The gas spring assembly set forth in claim 1 wherein the latch bushing includes a length measured along the longitudinal axis, and wherein the latch bushing radially supports the guide rod along the entire length of the latch bushing.

17. The gas spring assembly set forth in claim 3 wherein the guide rod, the latch bushing, the piston, the head portion, and the inner support tube are co-axially disposed relative to each other along the longitudinal axis.

18. The gas spring assembly set forth in claim 1 wherein the ledge is disposed nearer the longitudinal axis than the annular wall of the piston.

19. The gas spring assembly set forth in claim 3 wherein the gas spring assembly includes a pressurized gas disposed within the interior pressure chamber of the piston, wherein the pressurized gas biases against the head portion to bias the head portion toward the rearward end of the piston.

20. A gas spring assembly configured for an air gun, the gas spring assembly comprising:

a piston defining an interior pressure chamber, and including an annular wall extending along a longitudinal axis between a rearward end and a forward end, and an end wall attached to the annular wall and disposed adjacent the forward end of the annular wall;

a latch bushing attached to and disposed adjacent the rearward end of the annular wall, and defining a central bore extending along and concentric with the longitudinal axis;

an inner support tube disposed within the interior pressure chamber of the piston, and defining an inner bore extending along the longitudinal axis between the latch bushing and the end wall;

wherein the inner support tube is axially and radially supported by the latch bushing and the end wall to limit axial and radial movement of the inner support tube relative to the piston and the longitudinal axis;

a head portion disposed within the inner bore of the inner support tube and moveable within the inner bore relative to the inner support tube, along the longitudinal axis; and a guide rod slideably supported within the central bore of the latch bushing, with the piston axially moveable along the longitudinal axis relative to the guide rod between a compressed position and an un-compressed position;

wherein the guide rod includes a second end for engaging the head portion within the inner bore of the inner support tube;

wherein the guide rod includes a shank portion defining a first diameter substantially equal to the central bore of the latch bushing, the head portion defines a second diameter, and wherein the second diameter is larger than the first diameter; and wherein the latch bushing includes a ledge operable to engage a sear of a trigger assembly in latching engagement when the piston is disposed in the compressed position and the sear is disposed in a cocked position.

21. The gas spring assembly set forth in claim 20 wherein a forward end of the inner support tube is not sealed against the end wall, such that gas may flow between a portion of the interior pressure chamber defined by the inner bore of the inner support tube, and a portion of the interior pressure chamber defined between the inner support tube and an interior surface of the annular wall.

22. The gas spring assembly set forth in claim 20 wherein the head portion defines a recess, and the second end of the guide rod includes a projection sized to fit within the recess, with the projection seated within the recess.

23. The gas spring assembly set forth in claim 20 further comprising a dynamic head seal disposed between the head portion and the inner support tube, and operable to seal between an interior radial surface of the inner support tube and an exterior radial surface of the head portion.

* * * * *